US008820014B2

(12) United States Patent
Durnberger

(10) Patent No.: US 8,820,014 B2
(45) Date of Patent: Sep. 2, 2014

(54) PANEL OF A FLOOR SYSTEM

(75) Inventor: Johann Durnberger, Kirchberg/Tirol (AT)

(73) Assignee: Fritz Egger GmbH & Co. OG, Unterradlberg (AT)

( * ) Notice: Subject to any disclaimer, the term of this patent is extended or adjusted under 35 U.S.C. 154(b) by 92 days.

(21) Appl. No.: 13/376,634

(22) PCT Filed: Jun. 8, 2010

(86) PCT No.: PCT/EP2010/057994

§ 371 (c)(1),
(2), (4) Date: Oct. 17, 2012

(87) PCT Pub. No.: WO2010/142671

PCT Pub. Date: Dec. 16, 2010

(65) Prior Publication Data

US 2013/0036695 A1 Feb. 14, 2013

(30) Foreign Application Priority Data

Jun. 8, 2009 (DE) ..... 10 2009 024 511
Jul. 29, 2009 (DE) ..... 10 2009 035 275

(51) Int. Cl.
*E04C 1/00* (2006.01)

(52) U.S. Cl.
USPC ..... 52/309.3; 52/582.1

(58) Field of Classification Search
USPC ..... 52/309.3, 589.1, 588.1, 582.1
See application file for complete search history.

(56) References Cited

U.S. PATENT DOCUMENTS

| | | | |
|---|---|---|---|
| 2,947,040 | A | 8/1960 | Schultz |
| 6,505,452 | B1 | 1/2003 | Hannig et al. |
| 2007/0022689 | A1 | 2/2007 | Thrush et al. |

FOREIGN PATENT DOCUMENTS

| | | | |
|---|---|---|---|
| CN | 2804247 | Y | 8/2006 |
| DE | 19929896 | A1 | 1/2001 |
| DE | 10231921 | A1 | 1/2004 |
| DE | 102005061645 | A1 | 7/2007 |
| WO | 2004003314 | A1 | 1/2004 |

*Primary Examiner* — Basil Katcheves
(74) *Attorney, Agent, or Firm* — The Webb Law Firm

(57) ABSTRACT

The invention concerns a panel of a flooring system, in particular a laminate floor, with a first side edge, and with a second side edge which is arranged opposite the first edge, wherein the side edges can be locked with corresponding side edges of further panels, wherein the side edges can be brought into engagement with each other, wherein the first side edge is fitted with at least one locking lip, and with an elasticity groove adjacent to the locking lip, wherein the second side edge is fitted with a locking element and wherein the locking element in the locked state is in engagement with the locking lip. To be able to set the elasticity of the locking lip more satisfactorily, it is provided that the elasticity groove is at least partly filled with at least one filling compound.

18 Claims, 11 Drawing Sheets

PANEL OF A FLOOR SYSTEM

BACKGROUND OF THE INVENTION

1. Field of the Invention

The invention concerns a panel of a flooring system, in particular a laminate floor, with a first side edge and with a second side edge which is arranged opposite the first side edge, wherein the side edges can be locked with corresponding side edges of further panels, wherein the side edges can be brought into engagement with each other, wherein the first side edge is fitted with at least one locking lip and with an elasticity groove adjacent to the locking lip, wherein the second side edge is fitted with a locking element and in the locked state the locking element is in engagement with the locking lip.

2. Description of Related Art

Panels of this type are known for example from DE 102 31 921 A1. These panels have a carrier board of a wooden material such as a medium density fibre board (MDF) or high density fibre board (HDF). Also a laminate coating can be provided on this carrier board. The disadvantage of these panels is that the elasticity of the locking lip can only be set inadequately by the geometry of the elasticity groove.

SUMMARY OF THE INVENTION

The present invention therefore is based on the technical problem of specifying a panel in which the elasticity of the locking lip can be set more satisfactorily.

This object is achieved according to the invention by a panel of the type cited initially in that the elasticity groove is at least partly filled with at least one filling compound.

The elasticity of the locking lip can thus be set by suitable introduction of a filling compound. The locking lip is preferably made from a wooden material like the carrier board of the panel. The carrier board can be a medium density fibre board (MDF) or a high density fibre board (HDF). The material for the carrier board can also be a mixture of a wooden material and a plastic, known as a wood-plastic composite. The carrier board of the panel can have a coating on the top and/or underside such as in the form of a lacquer coating and/or a laminate coating. Corresponding coatings are known from the prior art so these are not described in more detail below.

The elasticity groove can have an opening perpendicular and/or parallel to the panel so that the locking lip can be bent suitably. In other words the elasticity groove can run substantially horizontally or substantially vertically as required, in particular depending on whether the locking lip runs substantially horizontally or vertically. The terms horizontal and vertical in this context should be understood as merely preferential directions, so that both the extent of the elasticity groove and the extent of the locking lip can be aligned clearly obliquely to the horizontal and/or the vertical and thus be provided more horizontally or more vertically.

A particularly simple locking can be achieved if the side edges can be brought into engagement substantially by a vertical movement, such that the first side edge is provided with a locking lip preferably directed downward from the top and with an elasticity groove arranged on the side of the locking lip facing away from the outer end of the first side edge, that the locking element of the second side edge is formed as a locking tongue and that in the locked state the locking tongue is engaged with the locking lip.

If two locking lips are provided, higher extraction forces can be tolerated. For common adjustment of the elasticity of the locking lips, the elasticity groove is suitably adjacent to both locking lips.

To simplify and/or strengthen the locking of two corresponding side edges, the locking element of the second side edge can be formed as a locking lip and an elasticity groove adjacent to the locking lip of the second side edge and at least partly filled with at least one filling compound can be provided on the second side edge.

A simple and secure locking of the panels in the horizontal and vertical direction is guaranteed in a preferred embodiment in that the first side edge is fitted with a fitting tongue preferably directed downward from the top and with a locking groove arranged between the fitting tongue and the locking lip, that the second side edge is fitted with a fitting groove adjacent to the locking tongue and that in the locked state the fitting tongue is in engagement with the fitting groove, wherein the distal end of the fitting tongue lies on the groove base of the fitting groove and wherein the locking tongue is in engagement with the locking groove and the locking lip.

To provide a suitable elasticity, the filling compound is an elastic compound, in particular a silicone, acrylate and/or melt adhesive.

Preferably the filing compound is an at least partly foaming filling compound in order to be able to adjust the elasticity of the locking lip suitably. A foaming filling compound is a compound which has a multiplicity of small gas-filled cavities or pores, wherein the cavities in turn can form an open and/or a closed porosity. Thus adaptation of the elasticity of the filling compound and hence the locking lip can easily take place by the selection of the degree of foaming i.e. the proportion of the gas-filled cavity or pore volume in relation to the total volume of the filling compound. In this context foaming degrees in the range of 10 to 35%, in particular 15 to 20%, have proved particularly suitable.

By the use of a foamed filling compound, alternatively or additionally a material saving can be achieved and hence a cost saving. Foamed filling compounds have the additional benefit that the elasticity groove is filled to its flanks and if required a full surface connection can be achieved between the filling compound and the flanks of the elasticity groove, in particular the flank adjacent to the locking lip.

Optionally the filling compound can be introduced into the elasticity groove at least in a substantially foamed state or at least in a substantially unfoamed state. In the latter case the filling compound substantially foams within the elasticity groove, wherein this is filled to the desired extent. In principle the filling compound can be foamed chemically and/or physically, such as by blowing in a gaseous medium. The gas enclosed in the filling compound, in particular for physical foaming, is air.

Good adhesive properties for joining the filling compound to the flanks of the elasticity groove are achieved with the foamed melt adhesives, also called hot melt adhesives. Corresponding filling compounds can be stored in a molten and foamed state in a tank and from there injected via a heated hose into the elasticity groove, wherein the panel and an application nozzle are moved relative to each other along the elasticity groove.

In particular if the panels are moved past the application nozzle in succession at a certain distance from each other i.e. with gaps in between, it is suitable if the output of filling compound is pulsed. The output can thus be adapted to the dimensions, advance speed and spacing of the panels such that no filling compound enters the gaps between the panels. This avoids contaminating plant parts and saves filling compound.

A pulsed output of filling compound can alternatively or additionally achieve the fact that the elasticity groove is only partly filled in the longitudinal extent. The introduction of filling compound can in principle take place directly after milling the elasticity groove out of the panel material.

To ensure as stable as possible a connection between adjacent panels with low force and without damaging the panels, it is suitable if the filling compound hardens slowly. Slow hardening in this context means hardening which takes place so slowly that on proper use the filling compound is only partly hardened during laying and only hardens fully after laying. During laying of the panel the filling compound and hence the locking lip are still quite flexible, while the filling compound only hardens some hours, days or weeks after laying so that a very stable connection is achieved between the panels.

As the filling compound should be prevented from hardening completely during storage, hardening can take place at least partly by drying and/or contact with air oxygen. The loss of moisture and the addition of air oxygen can be prevented or at least controlled suitably for example in the packed state of the panels by a suitable choice of packing material. After unpacking of the panels from the packing, the filling compound can, as required, harden much faster than before.

Alternatively or additionally the filling compound can be connected by material connection with the panel, such as via the filling compounds previously mentioned. Thus the filling compound and/or the locking lip are securely fixed even if the locking lip breaks.

For a precise setting of the bending behaviour of the locking lip over its length, the elasticity groove can be filled at least partly with at least two different filling compounds with different modulus of elasticity. A filling compound with a higher modulus of elasticity in the region of the groove base of the elasticity groove can reduce the bending of the locking lip so that lower stress peaks occur there.

A saving of filling compound and hence material costs can be achieved if the at least one filling compound is provided in segments along the longitudinal extent of the elasticity groove. Different filling compounds can also be provided along the longitudinal extent of the elasticity groove. In both cases the bending behaviour of the locking lip can be adapted in segments to particular requirements.

The elasticity groove can be angled in relation to the vertical such that the groove base of the elasticity groove in the horizontal direction is arranged closer to the outer end of the first side edge of the panel than the opening of the elasticity groove which preferably points towards the underside of the panel. As a result a suitable bending behaviour of the locking lip can be achieved and the locking lip stabilised.

Further preferably the flank of the locking lip adjacent to the elasticity groove can run substantially obliquely to the vertical as a whole, wherein the flank is spaced further in the horizontal direction from the outer end of the first side edge in the region of the opening of the elasticity groove than in the region of the base of the elasticity groove. Also the elasticity groove can have a main orientation aligned obliquely to the vertical between the opening of the elasticity groove and the base of the elasticity groove, without all flank regions of the elasticity groove also having to run obliquely to the vertical. By all these measures the bending behaviour of the locking lip can be improved or adjusted.

A particularly robust locking lip can be achieved if the locking lip has at least one tapered segment in the region of the base of the elasticity groove. This can be achieved in that the width of the locking lip in the region of the base of the elasticity groove has a taper at least in one cross section perpendicular to the side edge. The taper forms a nominal break point or break edge if the taper runs substantially along the entire locking lip, so that if the stress is too high, the locking lip breaks in the region of the base of the elasticity groove. Then the locking lip is fixed over a large surface by the filling compound in the elasticity groove. Firstly the locking lip does not detach from the panel. Secondly the locking lip can continue substantially to fulfil its function.

The elasticity groove in the region of the groove base can be expanded or widened in relation to the adjacent region of the elasticity groove in order to provide, in a particularly simple fashion, a nominal break point in the region of the groove base of the elasticity groove and/or to be able to introduce the filling compound into the elasticity groove particularly well without disruptive air inclusions, preferably adjacent to the locking lip. If the groove base is also or alternatively rounded, at corresponding points the stress peaks in the material can be reduced. The rounding can be provided at the groove base in the longitudinal extent of the elasticity groove and/or adjacent to the locking lip in the region of the groove base of the elasticity groove. A widening in the region of the groove base can be produced simply and precisely by a broaching tool or an end milling cutter.

The presence of an elasticity groove with at least one filling compound allows the locking lip to be made very thin in order to increase the influence of the elasticity groove and/or filling compound on the mechanical properties of the locking lip and optimise these mechanical properties. The locking lip therefore preferably has a smaller, in particular very much smaller horizontal width than the elasticity groove.

A better distinction of the panel sides can be achieved if the filling of the elasticity groove is dyed. The side edges can in this way be colour-coded so that the fitter can determine the correct arrangement of the panels more quickly and easily.

In a particularly preferred embodiment of the panel, the modulus of elasticity of the at least one filling compound is adapted to the application. For example the flexibility of the locking lip can be adapted by choice of the at least one filling compound and/or by targeted filling of the elasticity groove in segments.

The panels can be laid more easily if the panels have a third side edge and a fourth side edge opposite the third side edge, and the third and fourth side edges can be brought into engagement, preferably locked, with corresponding side edges of further panels substantially by a swivel movement about a parallel to the side edges to be joined. Not all side edges are thus brought into engagement by a substantially vertical movement. Via the swivel movement at the same time a first side edge and a third side edge can be connected, preferably locked, with a second and a third side edge of further panels.

In principle it is suitable if the first and second side edges are provided on the short narrow sides of the panel. Alternatively or additionally the panel is formed square.

BRIEF DESCRIPTION OF THE DRAWINGS

The invention is described in more detail below with reference to drawing which shows only embodiment examples. The drawing shows:

FIGS. 1 and 2 show two panels 1 and 2 from the prior art. The panels 1 and 2 have a first side edge 3 and a second side edge 4, wherein the side edges 3 and 4 lie opposite each other on the same panel 1 or 2. The side edges 3 and 4 can be locked with corresponding side edges 4 and 3 of further panels 1 and 2 as the profiles of the side edges 3 and 4 are formed corresponding to each other. Thus the side edges 3 and 4 can be brought into engagement with each other substantially by a vertical movement.

DESCRIPTION OF THE PREFERRED EMBODIMENTS

Figure 1:
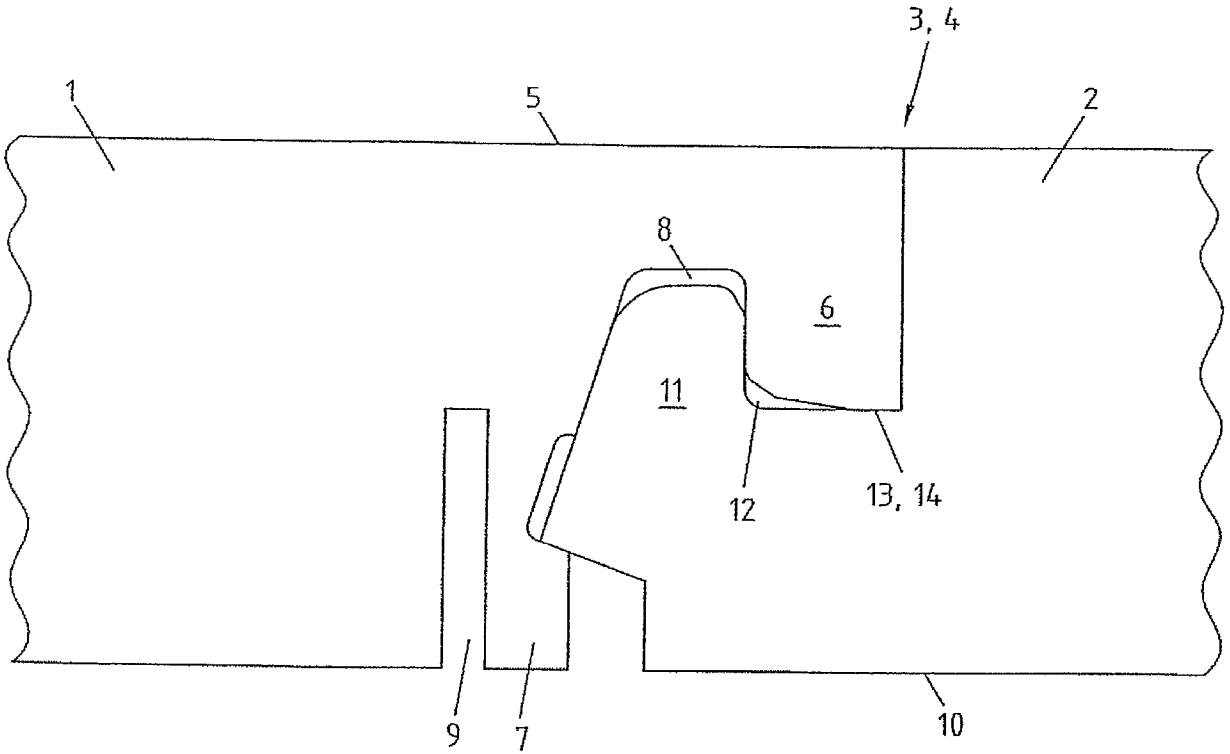
Fig. 1 (PRIOR ART)
FIG. 1 two locked panels from the prior art.

The first side edge 3 has a fitting tongue 6 directed down away from the top side 5, a locking lip 7 directed down from the top side 5, a locking groove 8 arranged between the fitting tongue 6 and the locking lip 7, and an elasticity groove 9 arranged on the side of the locking lip 7 facing away from the locking groove 8. The second side edge 4 however is fitted with a locking tongue 11 directed up from the underside 10 and with a fitting groove 12 adjacent to the locking tongue 11. In locked state the fitting tongue 6 is in engagement with the fitting groove 12, wherein the distal end 13 of the fitting tongue 6 lies on the groove base 14 of the fitting groove 12. Furthermore the locking tongue 11 is in engagement with the locking groove 8 and the locking lip 7.

To achieve the horizontal and vertical locking, the profile elements previously explained have the following fitting and locking surfaces. The fitting tongue 6 has a first fitting surface 15 adjacent to the top 5, a second fitting surface 16 arranged on the inside and a lower third fitting surface 13, namely the distal end of the fitting tongue 6 previously mentioned. The locking lip 7 is fitted with a first locking surface 17 running obliquely to the top 5. Furthermore on the second side edge 4 is provided a fourth fitting surface 18 adjacent to the top 5. The locking tongue 11 in turn has a second locking surface 19 running obliquely to the underside 10 and a fifth fitting surface 20. The groove base 14 of the fitting groove 12 forms the sixth fitting surface.

In the locked state the first fitting surface 15 lies on the fourth fitting surface 18, the second fitting surface 16 on the fifth fitting surface 20, the third fitting surface 13 on the sixth fitting surface 14 and the first locking surface 17 on the second locking surface 19. In other words the fitting surface pair 15 and 18 and the fitting surface pair 16 and 20 form the horizontal lock as these fitting surfaces run substantially vertically. Fitting surface pair 13 and 14 and locking surface pair 17 and 19 however form the vertical lock. As the locking surfaces 17 and 19 run obliquely, these have an effect both in relation to the horizontal and the vertical locking.

The locking groove 8 at the side opposite the fitting tongue 6 can have a first contact surface 21 while the locking tongue 7 on the side facing away from the fitting groove 12 can have a second contact surface 22 so that in the locked state the two side edges 3 and 4 lie against the first contact surface 21 and second contact surface 22. This is not itself necessary for locking of the profiles but leads to a stabilisation of the entire profile.

Figure 2:
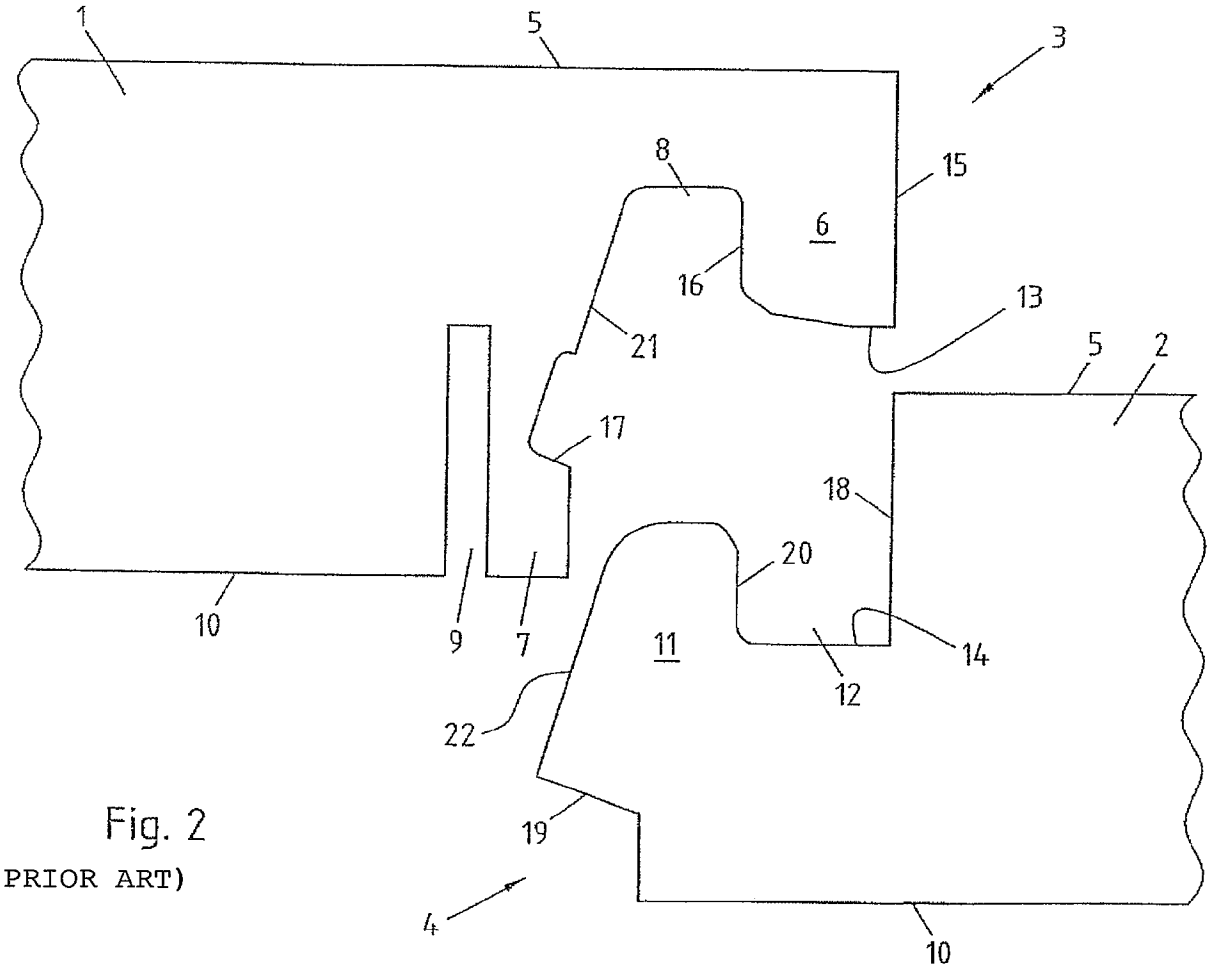
Fig. 2 (PRIOR ART)
FIG. 2 the panels in FIG. 1 in separated state.
Figure 3A:
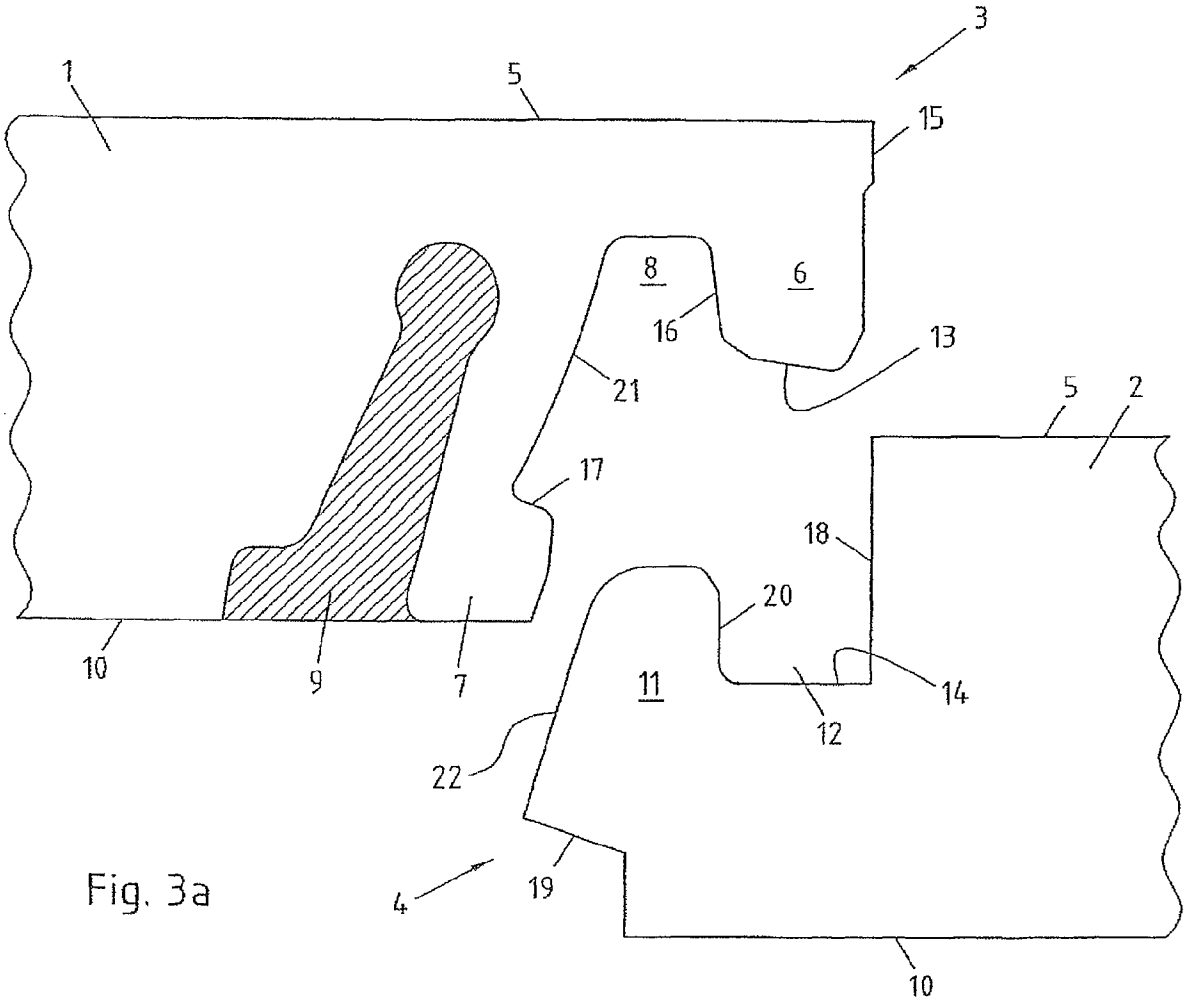
FIG. 3 a first embodiment example of a panel according to the invention.
Figure 3B:
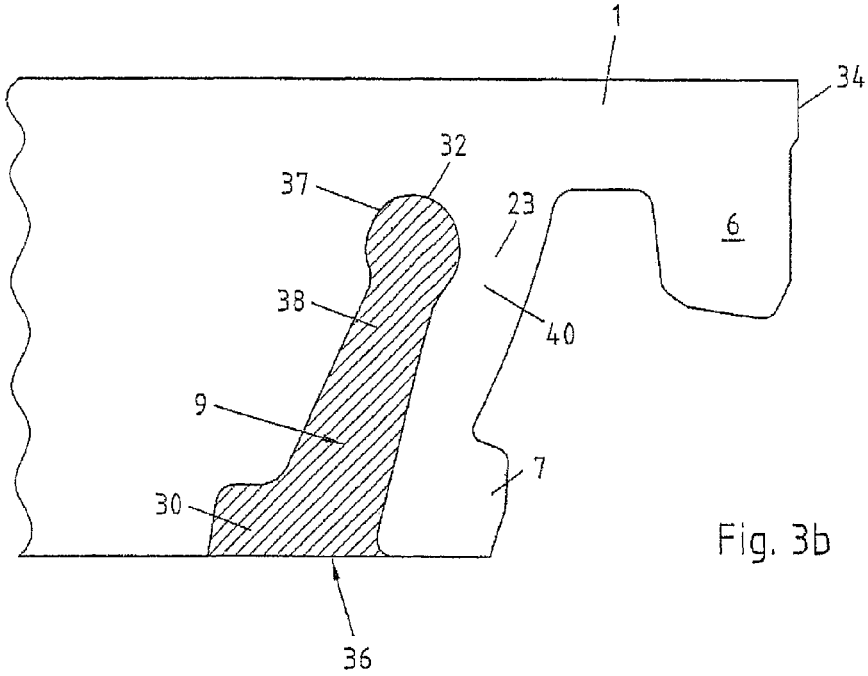
Figure 3C:
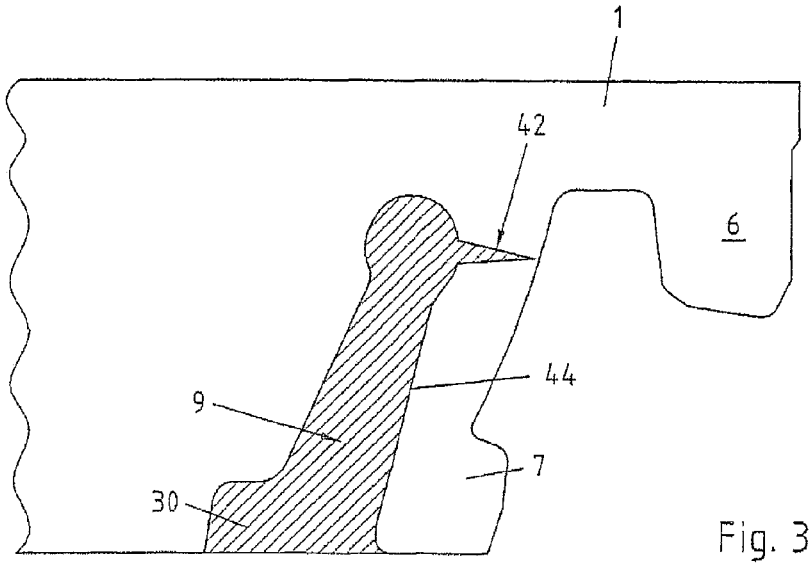

FIGS. 3*a* to 3*c* show a derivation of the panel 1 shown in FIGS. 1 and 2. The common features of the panel arise as described above. The derivation lies substantially in that the elasticity groove 9 is filled with a filling compound 30. Therefore in FIGS. 1 to 3 the same reference numerals are used for the same elements.

The filling compound 30 is preferably an elastic compound, in particular a silicone, acrylate and/or melt adhesive. The elasticity groove 9 can if necessary also be filled only partly with the filling compound or different filling compounds. Optionally the elasticity groove can also be unfilled. The elasticity groove 9 of the panel 1 shown is angled in relation to the vertical such that the groove base 32 of the elasticity groove 9 is arranged in the horizontal direction closer to the outer end 34 of the first side edge 3 of the panel 1 than the opening 36 of the elasticity groove 9. The opening 36 in the embodiment example shown is aligned parallel to panel 1. The outer end is the end of the panel in a direction perpendicular to the first edge and parallel to the panel.

The elasticity groove 9 in the region 37 of the groove base 32 is furthermore widened in relation to the adjacent region 38 of the elasticity groove 9 so as to form a nominal break point 40 in the form of a tapered segment 23 of the locking lip 7. On mechanical failure, a crack 42 is formed at the nominal break point 40. The locking lip 7 is held at the flank 44 adjacent to the elasticity groove by the filling compound 30 over a large area as the filling compound 30 is connected by material fit with the panel 1 and in particular the locking lip 7.

In the panel 1 shown in FIG. 3, the locking lip 7 provided on the first side edge 3 runs substantially from top to bottom, wherein the elasticity groove 9 extends in the same direction on the side of the locking lip 7 facing away from the outer end 34 of panel 1. The locking tongue 11 provided on the second side edge 4 runs corresponding to said groove and in the connected state of the panel 1, 2 is in engagement with the locking lip 7 while the downwardly directed fitting tongue 6 is in engagement with the fitting groove 12 and the distal end 13 of the fitting tongue 6 lies on the groove base 14 of the fitting groove 12. The locking tongue 11 in the joined state of the panels 1, 2 is in engagement both with the locking lip 7 and with the locking groove 8, the locking groove 8 being arranged between the fitting tongue 6 and the locking lip 7.

Figure 4:
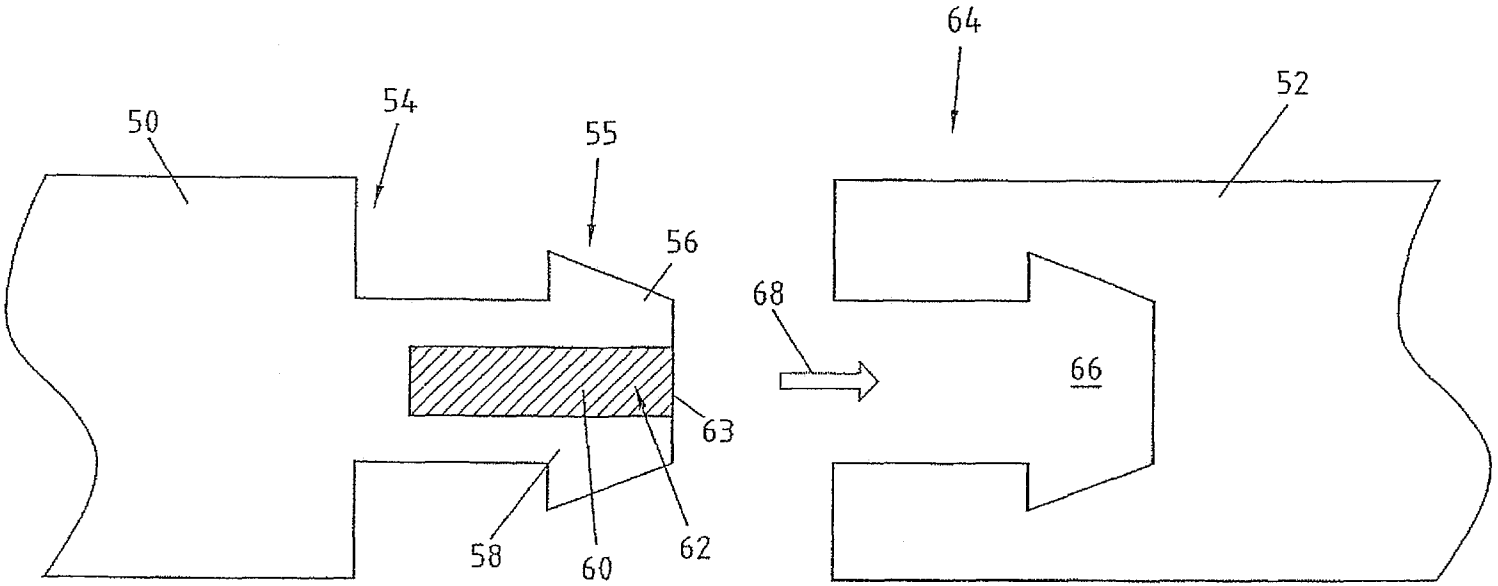
FIG. 4 a second embodiment example of a panel according to the invention.

FIG. 4 shows two similar panels 50, 52 with a first side edge 54 which for connection are arranged substantially in a direction parallel to panels 50, 52 and vertical to the first side edge 54. The first side edge 54 has a catch element 55 with two substantially horizontal locking lips 56, 58. Between and adjacent to the locking lips 56, 58 is an elasticity groove 62 filled with a filling compound 60. The elasticity groove 62 extends substantially parallel to the panel 50 and has an opening 63 which is oriented vertically to the panel 50. The second side edge 64 has a recess 66 corresponding to the catch element 55. On connection of the catch element 55 and recess 66 in the direction of the arrow 68, the filling compound 60 is compressed and the locking lips 56, 58 are bent in the direction of the elasticity groove 62.

Figure 5:
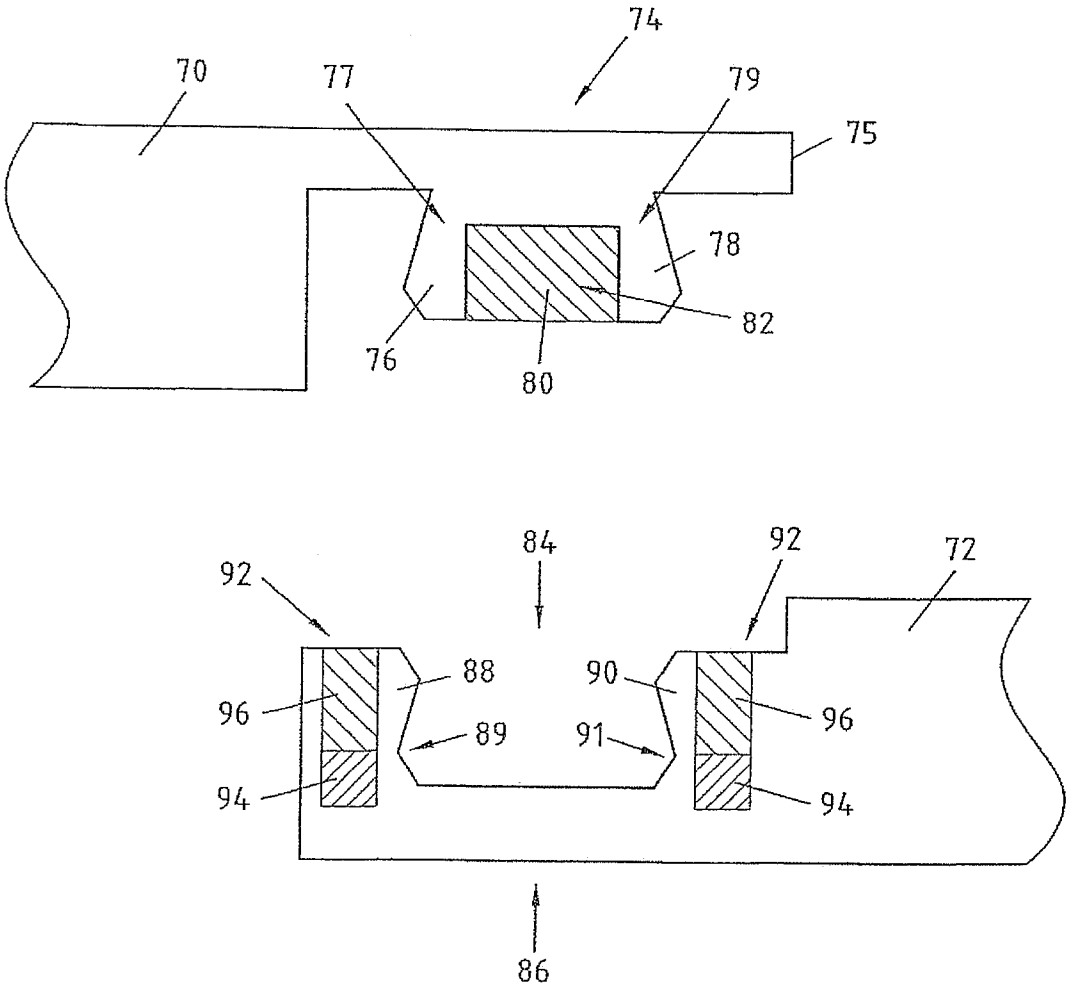
FIG. 5 a third embodiment example of a panel according to the invention.

FIG. 5 shows two further panels 70, 72 which are provided for connection by a substantially vertical movement. The first side edge 74 of panels 70, 72 has an outer end 75 and two downwardly pointing locking lips 76, 78 adjacent to an elasticity groove 82 that is filled with a filling compound 80 and open to the bottom. In the regions facing away from the free ends of the locking lips 76, 78, tapered segments 77, 79 are also provided which on increased load can serve as nominal break points for the locking lips 76, 78. The locking element 84 of the second side edge 86 of the similar panels 70, 72 has two locking lips 88, 90 with correspondingly tapered segments 89, 91, wherein each of the locking lips 88, 90 is adjacent to an elasticity groove 92. The elasticity grooves 92 in a region adjacent to the groove base and in a region adjacent to the opening of the elasticity groove 92 have filling compounds 94, 96 with different moduli of elasticity.

Figure 6:
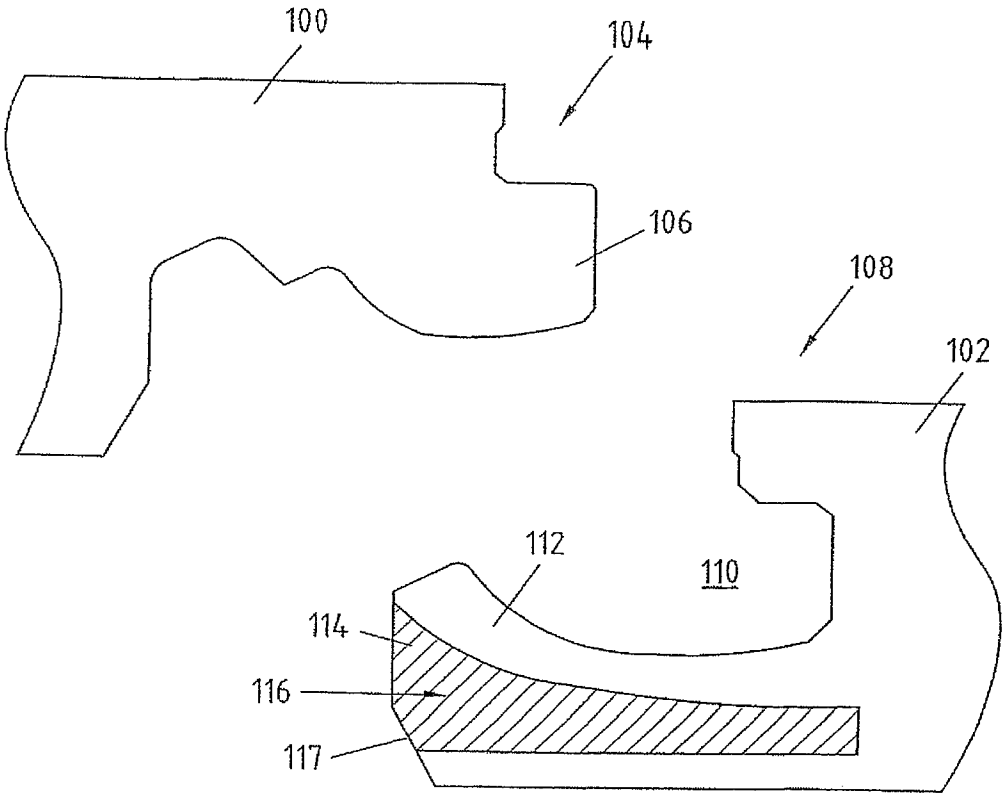
FIG. 6 a fourth embodiment example of a panel according to the invention.

FIG. 6 shows panels 100, 102 with a first side edge 104 which has a tongue 106 while the second side edge 108 of the panels 100, 102 has a corresponding recess 110. The tongue 106 can be locked with recess 110 via a swivel movement. The second side edge 108 on a lower segment largely parallel to panel 102 and protruding outward thus has a protruding locking lip 112 and an elasticity groove 116 filled with filling compound 114 and extending substantially in a horizontal direction. The elasticity groove 116 expands in the direction of the protruding end of the elasticity groove 116 which there ends in an opening 117 perpendicular to panel 72.

Figure 7:
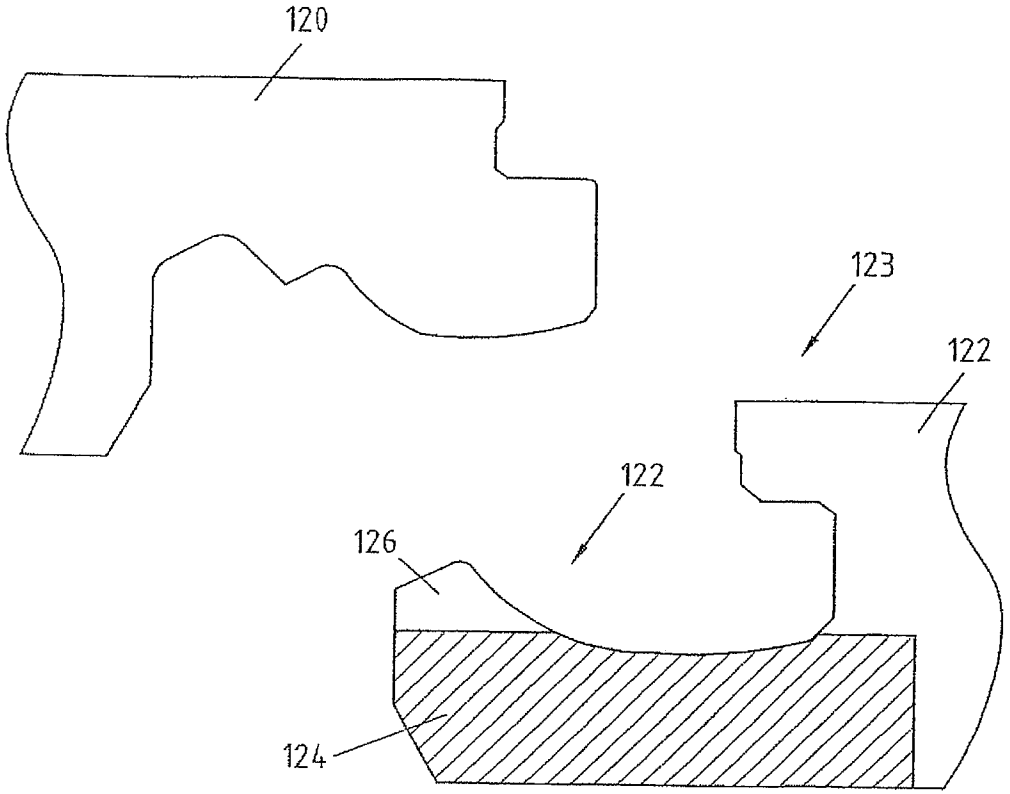
FIG. 7 a fifth embodiment example of a panel according to the invention.

FIG. 7 shows two panels 120, 122 which resemble the panels 100, 102 in FIG. 6. The lower protruding lip 122 of the second side edge 123 is largely formed as an elastic element 124 of an elastic filling compound. At the end of the elastic element 124 is a locking means 126 made of a wooden material and connected with the remaining panel only via the elastic element 124.

Figure 8:
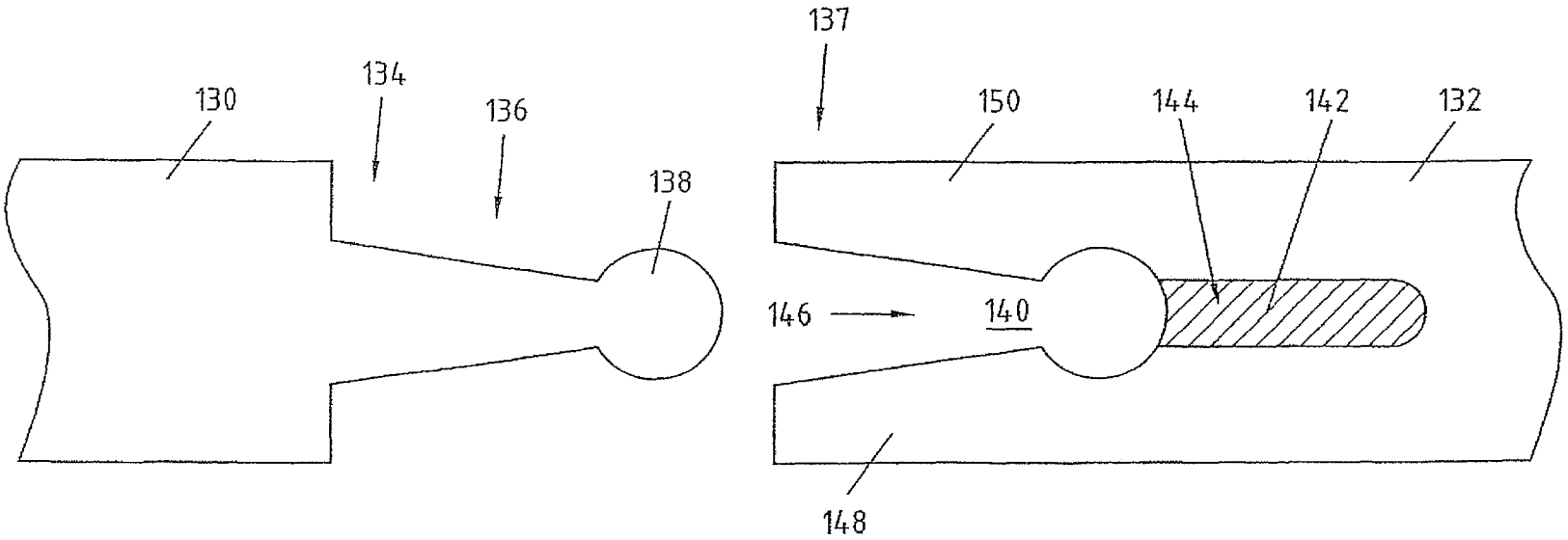
FIG. 8 a sixth embodiment example of a panel according to the invention.

FIG. 8 shows two further panels 130, 132 with corresponding first side edges 134 with a catch element 136 and second side edges 137 with a recess 140. The catch element has a thickening 138. In the extension of the recess 140 is provided an elasticity groove 144 filled with a filling compound 142 and also extending in the horizontal direction. When the panels 130, 132 are joined in the direction of arrow 146, the locking lips 148, 150 adjacent to the elasticity groove 144 on both sides are spread apart. Because of the filling compound 142 in the elasticity groove 144, the panel 132 does not crack in the region of recess 140, in particular in the region of the groove base of recess 140.

Figure 9:
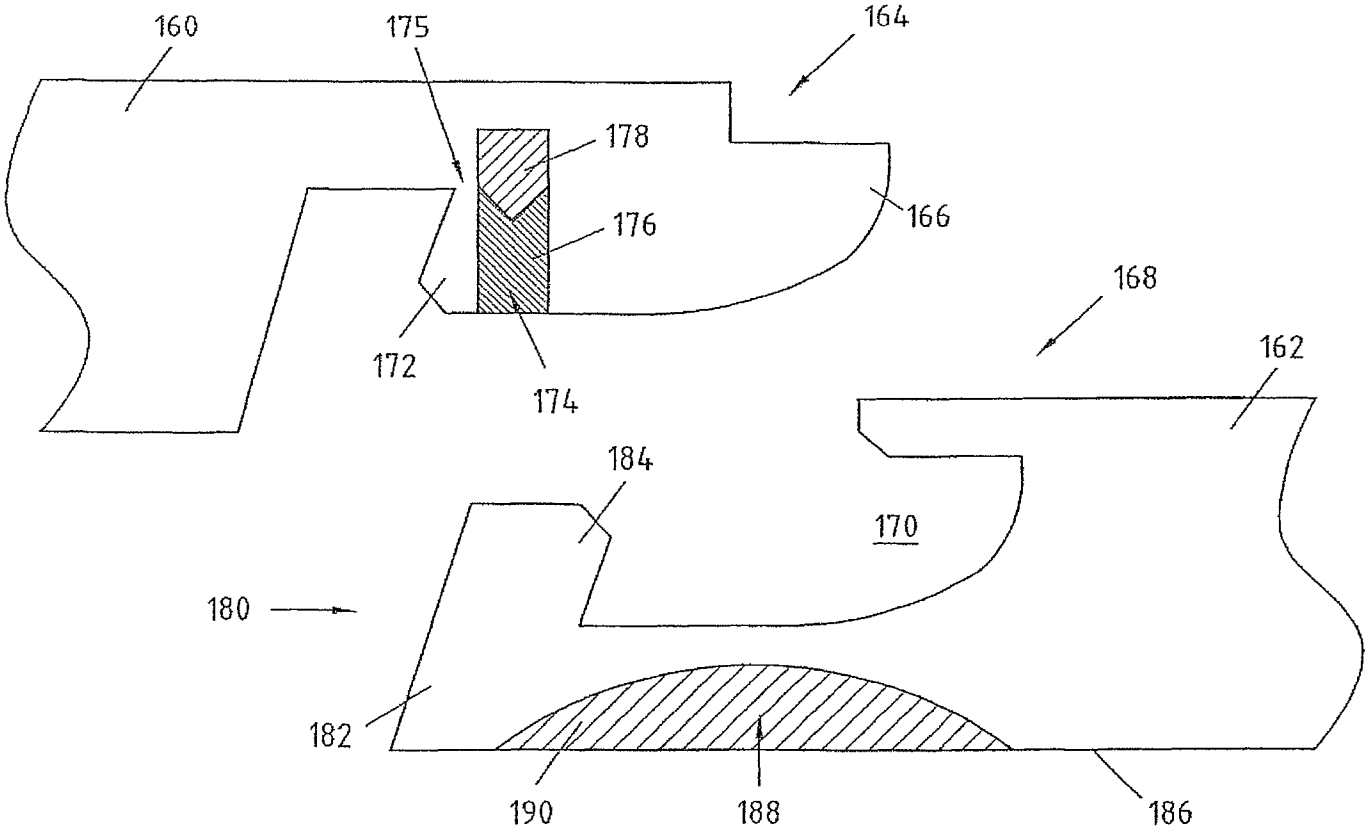
FIG. 9 a seventh embodiment example of a panel according to the invention.

FIG. 9 shows panels 160, 162 in which the first side edge 164 has a tongue 166 and the second side edge 168 has a corresponding groove 170. The side edges 164, 168 can be brought into engagement with each other substantially by a swivel movement of the first panel 160 about a parallel to the side edges 164, 168 to be connected. The tongue 166 furthermore has a locking lip 172 extending downwards with an elasticity groove 174 adjacent thereto. The elasticity groove 174 is adjacent to the side of the locking lip 172 facing the outer end of the panel 160. Furthermore a tapered segment 175 is provided on the locking lip 172 in the region facing away from the free end. Here usually the locking lip 172 will break first under increased load. The elasticity groove 174 is filled with two filling compounds 176, 178 of different moduli of elasticity. The locking element 180 is formed as a lower lip 182 protruding outwards parallel to panel 162 with a protrusion 184 at the distal end. The lower lip 182 on the underside 186 has a recess 188 with is filled with a filling compound 190 that positively influences the bending of the lower lip 182 on joining of panels 160, 162.

Figure 10:
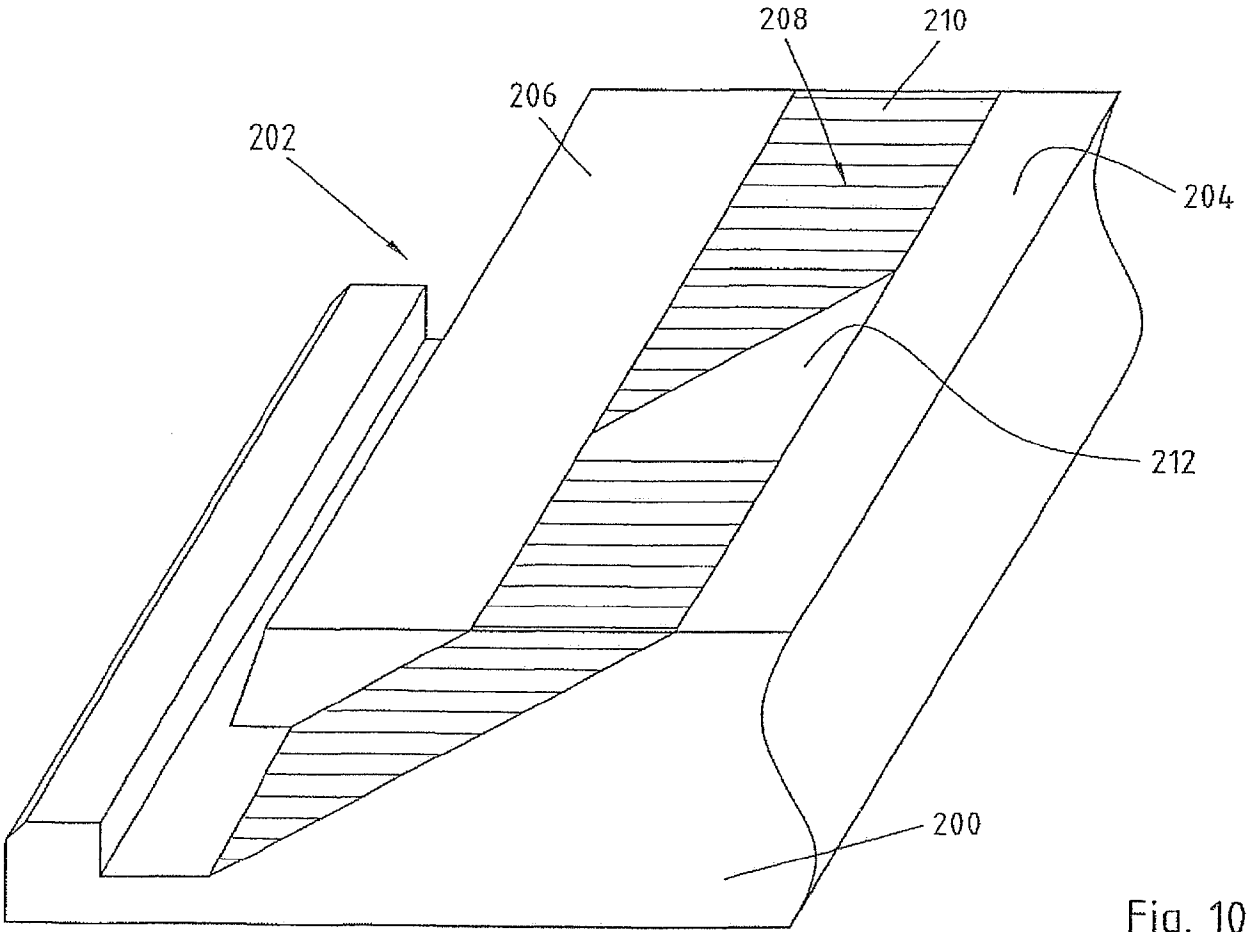
FIG. 10 an eighth embodiment example of a panel according to the invention.

The panel 200 shown in FIG. 10 has a locking lip 206 on a first side edge 202 on the underside 204. The locking lip 206 is adjacent to an elasticity groove 208 which is filled with a filling compound 210 in segments with interruptions 212. Such a segmented filling of an elasticity groove is in principle also possible with the other embodiment examples. The second side edge of the panel 200 corresponding to the first side edge 202 can if necessary be formed corresponding to the second side edge 4 shown in FIG. 3*a*.

The invention claimed is:

1. A panel of a flooring system, in particular a laminate floor, the panel comprising:
- a first side edge, and
- a second side edge which is arranged opposite the first edge,
- wherein the first and second side edges can be locked with corresponding side edges of further panels,
- wherein the side edges can be brought into engagement with each other,
- wherein the first side edge is fitted with at least one locking lip and with an elasticity groove adjacent to the locking lip,
- wherein the second side edge is fitted with a locking element,
- wherein the locking element in the locked state is in engagement with the locking lip,
- wherein the elasticity groove is filled at least partly with at least one filling compound, and
- wherein the elasticity groove is angled in relation to a vertical direction such that a groove base of the elasticity groove in a horizontal direction is arranged closer to an outer end of the first side edge of the panel than an opening of the elasticity groove.

2. The panel according to claim 1, wherein the elasticity groove has an opening perpendicular and/or parallel to the panel.

3. The panel according to claim 1, wherein
- the first and second side edges can be brought into engagement with each other substantially by a vertical movement,
- wherein the first side edge is fitted
- with a locking lip directed downward
- and with an elasticity groove arranged on the side of the locking lip facing away from the outer end of the first side edge,
- wherein the locking element of the second side edge is formed as an upward directed locking tongue, and
- wherein in locked state the locking tongue is in engagement with the locking lip.

4. The panel according to claim 1, wherein an elasticity groove is provided adjacent to a locking lip of the second side edge and at least partly filled with at least one filling compound.

5. The panel according to claim 1, wherein
- the first side edge is fitted with a fitting tongue directed away downwards and with a locking groove arranged between the fitting tongue and the locking lip,
- wherein the second side edge is fitted with a fitting groove adjacent to the locking tongue,
- wherein in a locked state the fitting tongue is in engagement with the fitting groove, wherein a distal end of the fitting tongue lies on the groove base of the fitting groove and wherein the locking tongue is in engagement with the locking groove and the locking lip.

6. The panel according to claim 1, wherein the filling compound is an elastic compound, in particular a silicone, an acrylate and/or a melt adhesive.

7. The panel according to claim 1, wherein the filling compound is a foamed filling compound, preferably a foamed melt adhesive.

8. The panel according to claim 1, wherein the filling compound is a filling compound which hardens slowly, preferably at least partly by drying or by contact with air oxygen.

9. The panel according to claim 1, wherein the filling compound is connected by a material fit with the panel.

10. The panel according to claim 1, wherein the elasticity groove is at least partly filled with at least two different filling compounds and wherein the two filling compounds have different moduli of elasticity.

11. The panel according to claim 1, wherein the at least one filling compound is provided in segments along a longitudinal extent of the elasticity groove.

12. The panel according to claim 1, wherein the locking lip has at least one tapered segment in a region of a base of the elasticity groove and/or in a region facing away from a free end.

13. The panel according to claim 1, wherein the elasticity groove in a region of a groove base is expanded in relation to an adjacent region of the elasticity groove.

14. The panel according to claim 1, wherein the locking lip has a smaller horizontal width than the elasticity groove.

15. The panel according to claim 1, wherein the filling compound of the elasticity groove is dyed.

16. The panel according to claim 1, wherein the elasticity modulus of the at least one filling compound is adapted according to an application.

17. The panel according to claim 1, wherein the panel has a third side edge and a fourth side edge opposite the third side edge, and that the third and fourth side edges are lockable with corresponding side edges of further panels substantially by a swivel movement about a parallel to the side edges to be joined.

18. The panel according to claim 1, wherein the first and second side edges are provided on short narrow sides of the panel.

* * * * *